US006770364B2

(12) United States Patent
Murata et al.

(10) Patent No.: US 6,770,364 B2
(45) Date of Patent: Aug. 3, 2004

(54) ARTIFICIAL HAIR AND METHOD FOR PRODUCTION THEREOF

(75) Inventors: Shoichi Murata, Takasago (JP); Nobuyuki Nishi, Takasago (JP); Kenichiro Cho, Kakogawa (JP); Masaaki Yokoe, Kakogawa (JP); Akio Konishi, Kakogawa (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 10/466,982

(22) PCT Filed: Jan. 25, 2002

(86) PCT No.: PCT/JP02/00543

§ 371 (c)(1),
(2), (4) Date: Jul. 21, 2003

(87) PCT Pub. No.: WO02/061187

PCT Pub. Date: Aug. 8, 2002

(65) Prior Publication Data

US 2004/0074509 A1 Apr. 22, 2004

(30) Foreign Application Priority Data

Jan. 29, 2001 (JP) ..... 2001-020463
Jan. 30, 2001 (JP) ..... 2001-021333
Feb. 2, 2001 (JP) ..... 2001-026655

(51) Int. Cl.[7] ..... D01F 6/00

(52) U.S. Cl. ..... 428/364; 428/394; 264/182; 264/210.8; 264/211.17

(58) Field of Search ..... 428/364, 394; 264/342 RE, 182, 211.17, 210.8

(56) References Cited

U.S. PATENT DOCUMENTS 4,293,613 A * 10/1981 Bach et al. ..... 428/364

FOREIGN PATENT DOCUMENTS

| | | | |
|---|---|---|---|
| EP | 0 292 907 | | 5/1988 |
| JP | 47-32129 | | 11/1972 |
| JP | 55-158322 | | 12/1980 |
| JP | 1-148806 | | 6/1989 |
| JP | 2002242016 | A * | 8/2002 |
| JP | 20002315765 | A * | 10/2002 |

* cited by examiner

*Primary Examiner*—N. Edwards
(74) *Attorney, Agent, or Firm*—Hogan & Hartson LLP

(57) ABSTRACT

The present invention provides synthetic hair comprising fiber of 30 to 100 decitex, comprising an acrylic copolymer obtained by copolymerizing acrylonitrile, vinylidene chloride and a vinyl monomer containing a sulfonic acid group and a process for preparing the synthetic hair. The synthetic hair of the present invention has favorable surface gloss and excellent knot strength and hair breaking in the sewing machine steps when preparing the weft and in implanting hair to skin when preparing wigs and toupees is improved. The fiber which becomes the synthetic fiber is prepared by preparing a spinning solution containing, in a polymer solution of an acrylic polymer comprising 40 to 74% by weight of acrylonitrile, 25 to 59% by weight of vinylidene chloride and 1 to 5% by weight of a vinyl monomer containing a sulfonic acid group copolymerizable therewith and a good solvent, 5 to 20 parts by weight of water based on 100 parts by weight of the polymer, forming fiber by wet spinning, conducting drawing treatment so that the total drawing ratio becomes 2.5 to 12 times and conducting relaxing treatment so that the total relaxation ratio becomes at least 15%. By this method, synthetic hair is obtained, in which the gloss contrast is at least 0.88, the knot strength is at least 0.5 cN/decitex and the average fineness of the filament is 30 to 100 decitex.

12 Claims, 4 Drawing Sheets

ARTIFICIAL HAIR AND METHOD FOR PRODUCTION THEREOF

TECHNICAL FIELD

The present invention relates to synthetic hair used for hair goods such as wigs, hairpieces and weavings and doll hair and a process for preparing the same. More specifically, the present invention relates to synthetic hair which is made of fiber prepared using an acrylic polymer comprising acrylonitrile, vinylidene chloride and a vinyl monomer containing a sulfonic acid group copolymerizable therewith and has favorable surface gloss, curl setting property and hairstylability (property of creating various hairstyles when made into a wig), excellent knot strength and is suitable for preparation of wigs and toupees, and a process for preparing the synthetic hair.

BACKGROUND ART

Qualities conventionally demanded in material for synthetic hair are curl shape, appearance such as gloss and coloring, hair care properties such as combing properties and stylability, dye-affinity, hackling properties, curl setting properties, processability for machine sewing and hair implant to skin, volume, texture and flame retardant property.

Of the material for synthetic hair which is currently available, in the case of material for synthetic hair (fiber) of polypropylene or polyester, flame retardant property is poor and in the case of material for synthetic hair using vinyl chloride or vinylidene chloride, dye-affinity and volume per weight unit are poor.

As a typical material with the demanded properties, human hair and synthetic hair comprising acrylic fiber obtained by copolymerizing acrylonitrile and vinyl chloride is known. However, when human hair is used as a material, procuring the material and hair length are problems. Vinyl chloride which is a high pressure gas is industrially difficult to handle and widespread use of the acrylic polymer has been inhibited as preparing the acrylic copolymer is restricted in many ways in terms of equipment. Also, depending on the product, the acrylic fiber obtained by copolymerizing acrylonitrile and vinyl chloride is balanced in gloss, coloring and texture and is flame resistant. However, curl setting properties are faulty as the set curl shape changes over time and improvement in stylability is desired as hairstyles which the stylability of current acrylic fiber cannot achieve are in demand.

On the other hand, using vinylidene chloride instead of vinyl chloride has the advantages of few restrictions in manufacturing equipment, favorable polymerization properties and superior flame retardant property compared to vinyl chloride. When preparing by wet spinning fiber made of an acrylic copolymer obtained by copolymerizing at least 25% by weight of vinylidene chloride, organic solvent is often used as the solvent. However, when a good solvent is used, the spinning solution discharged through the spinneret coagulates by counter diffusion with the coagulation solution causing unevenness in the inner structure of the fiber as the fineness of the fiber increases and as a result, void tends to remain inside the fiber. Consequently, favorable gloss can only be obtained in the case of a fineness of less than 30 decitex.

For example, fiber made of an acrylic copolymer obtained by copolymerizing vinylidene chloride is disclosed in JP-A-48-77122, which suggests a process for preparing fiber in which densifying the fiber structure and improving gloss is attempted by adding water to the spinning solution. However, as the copolymer contains at least 80% by weight of acrylonitrile, flame retardant property is inferior.

Also, JP-A-51-4324 discloses a process for preparing an acrylic fiber which comprises copolymerizing 0.1 to 10% by weight of a monomer in which a sulfonic acid group is introduced into an amide compound containing a vinyl group such as acrylic amide or methacrylic amide. This process attempts to improve gloss in fiber of a thin fineness. However, favorable gloss is not obtained in fiber with a thick fineness which is suitable for hair material. Furthermore, fiber obtained by wet spinning an acrylic copolymer obtained by copolymerizing at least 25% by weight of vinylidene chloride has the disadvantage that processing tends to be difficult as knot strength is weak and breaking of the hair is frequent when implanting hair to prepare a wig or toupee, due to the fiber properties. This tendency is particularly noticeable in thick fineness.

An example of a method for improving knot strength is disclosed in JP-48-61727. This method comprises the following steps. A tow obtained by conventional wet spinning is stretched in a hot water environment, passed through a heating roller and further stretched in a vapor zone filled with saturated vapor. Then, in the vapor zone filled with saturated vapor, using a heating roller having a winding speed slower than that of the previous zone, the tow is wound and passed through a cooling roll. However, by this method, fiber of a thick fineness with favorable gloss could not be obtained under the conditions in which knot strength was satisfactory.

The present inventors believe the reason for this are as described below. That is, usually in wet spinning of fiber in which a good solvent is used, the fiber stretched in a hot water bath is devitrified by the void inside the fiber and so gloss is exhibited in the following step of the heating roller. However, later when the tow is relaxed in a dampened state under a saturated vapor environment, the void which has vanished reappear and consequently a decrease in gloss occurs. More specifically, as described above, the void within the fiber tends to remain as the fineness becomes thicker as unevenness in coagulation becomes noticeable and the number and size of the void tends to increase. The developed voids are mainly stretched out by stretching in a hot water bath and the diameter of the void area present perpendicular to the fiber axis become small. Furthermore, due to the shrinking force and collapsing effect by heating which occur from heating to dry, the number and size of the void seems to have decreased. However, in this method, because the tow is in a wet state when relaxing, the tow is plasticized by the influence of excess hot water on the fiber surface and activity of the polymer molecules are advanced, revealing again the voids within the fiber which were collapsed by heating. A decrease in gloss is thought to occur because diffused reflection due to these voids occurs inside the fiber.

The synthetic fiber having as the main component acrylonitrile and vinylidene chloride, which is superior in flame retardant property and has few restrictions for preparing the copolymer, has the above technical problems. Therefore, in reality, quality in thick fiber of more than 30 decitex could not be fulfilled. As a result, development of toupees and wigs, in which thick fiber is used, favorable gloss is demanded and at least a certain knot strength is required, was thought to be limited.

That is, the object of the present invention is to provide synthetic hair made of fiber comprising an acrylic copolymer obtained by copolymerizing acrylonitrile and vinylidene chloride as the main components, which has favorable gloss, which is a property desired in material for synthetic hair, knot strength improved to at least a certain strength and good processability for wigs and toupees.

Furthermore, the present invention aims to provide synthetic hair which has good curl setting properties and high hairstylability as synthetic hair used in hair goods and enables planning of a wide variety of projects by using as material for synthetic hair in hair goods.

DISCLOSURE OF INVENTION

In order to obtain the above synthetic hair, a polymer solution comprising a polymer obtained with acrylonitrile and vinylidene chloride as the main components and a good solvent is spun. Wet spinning, in which the amount of solvent remnant in the fiber is less than in dry spinning, may be employed. At this time, in order to make the structure of coagulated fiber during wet spinning even compared to fiber of a thin fineness, two methods of (1) improvement in the coagulation properties of the polymer and (2) adjusting the spinning solution can be combined. As a result, the balance between the solvent diffusion from the spinning solution to the coagulant bath and the coagulant, that is water, diffusion from the coagulant bath to the spinning solution is suitably adjusted, to improve gloss in fiber of thick fineness.

Also, the desired synthetic hair was found by attempting to improve knot strength by imparting a specific relaxation ratio after drying in order to improve processability for wigs and toupees and the present invention was reached.

That is, the present invention relates to synthetic hair comprising fiber obtained from an acrylic polymer comprising 40 to 74% by weight of acrylonitrile, 25 to 59% by weight of vinylidene chloride and 1 to 5% by weight of a vinyl monomer containing a sulfonic acid group copolymerizable therewith, wherein the fiber has a gloss contrast of at least 0.88 and an average filament fineness of 30 to 100 decitex.

In the synthetic hair, the fiber preferably has a knot strength of at least 0.5 cN/decitex.

In the synthetic hair, the fiber is preferably obtained by wet spinning using a good solvent.

The good solvent is preferably at least one member selected from the group consisting of dimethylformamide (hereinafter DMF), dimethylacetamide (hereinafter DMAc) and dimethyl sulfoxide (hereinafter DMSO).

The present invention also relates to a process for preparing the synthetic hair which comprises the steps of preparing a spinning solution containing, in a polymer solution of an acrylic polymer comprising 40 to 74% by weight of acrylonitrile, 25 to 59% by weight of vinylidene chloride and 1 to 5% by weight of a vinyl monomer containing a sulfonic acid group copolymerizable therewith and a good solvent, 3 to 25 parts by weight of water based on 100 parts by weight of the polymer, forming fiber by wet spinning the spinning solution, conducting drawing treatment so that the total drawing ratio of the fiber becomes 2.5 to 12 times and conducting relaxing treatment so that the total relaxation ratio of the fiber becomes at least 15%.

In the process, the relaxing treatment is preferably divided into two or more times.

In the process, the relaxing treatment is preferably conducted in a vapor atmosphere of a pressurized and/or overheated state after drying the fiber.

In the process, the vapor atmosphere preferably has a temperature of 120° to 200° C.

BEST MODE FOR CARRYING OUT THE INVENTION

Figure 1:
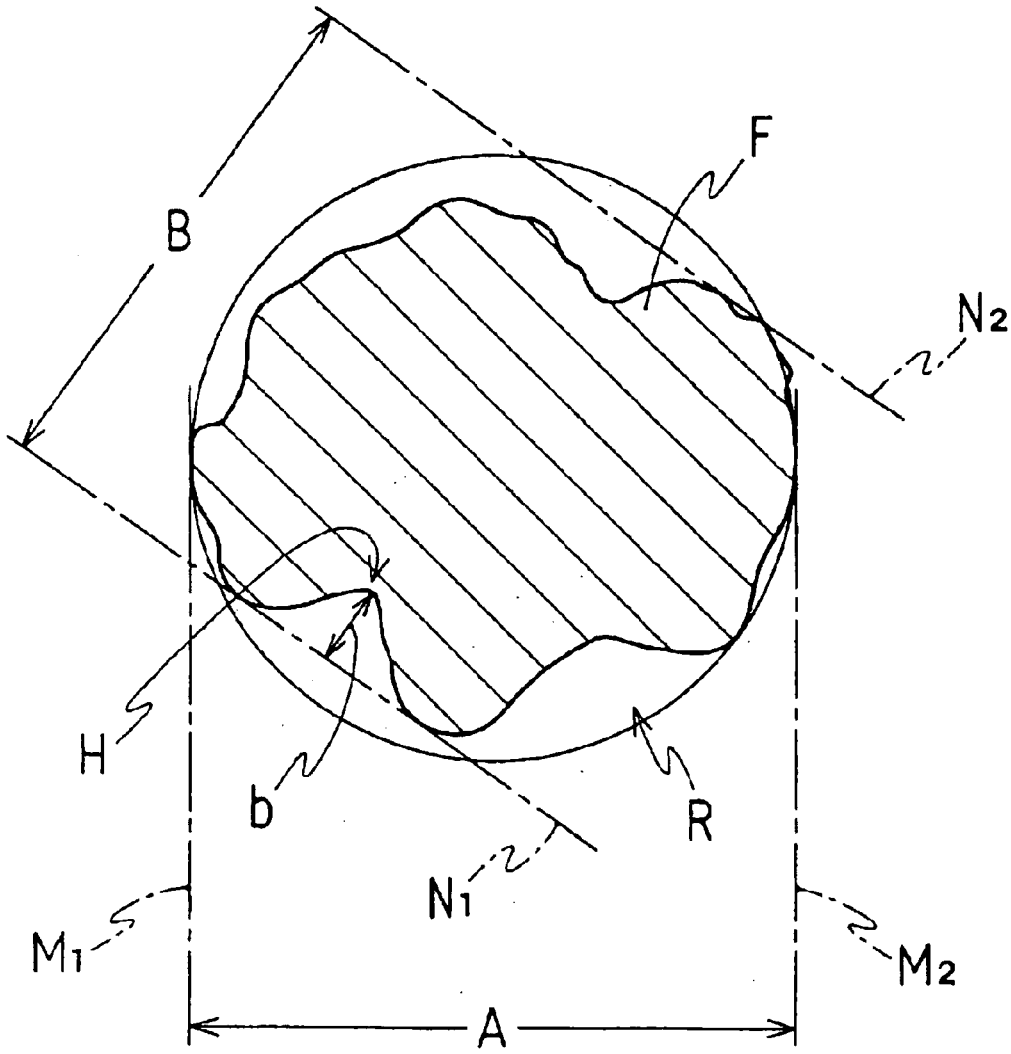
FIG. 1 is a diagram describing the method of measuring the degree of circularity and the dented degree of the fallen areas in the cross section of the fiber.

The synthetic hair of the present invention is a fiber using an acrylic polymer comprising 40 to 74% by weight of acrylonitrile and 25 to 59% by weight of vinylidene chloride, preferably 44 to 69% by weight of acrylonitrile and 30 to 55% by weight of vinylidene chloride, more preferably 46 to 63% by weight of acrylonitrile and 36 to 53% by weight of vinylidene chloride. When the content of vinylidene chloride is less than 25% by weight, flame retardant property tends to be insufficient. When the content of acrylonitrile is less than 40% by weight, the upper limit temperature for heat setting curls, which affects heat resistance, decreases and as a result, the processing temperature range becomes narrow, handling becomes difficult and ability to maintain curl shape decreases. Vinylidene chloride is used because, compared to vinyl chloride, flame retardant property can be obtained with a smaller amount of copolymers, the conversion ratio into polymers is high as polymerizability is high and restrictions for preparation equipment are few. Using vinyl chloride instead of vinylidene chloride is undesirable as special equipment for high pressure gas becomes necessary and the preparation equipment becomes restricted. Also, using vinyl bromide or vinylidene bromide is undesirable as light resistance of the copolymer is poor, material costs are high and versatility is inferior compared to vinylidene chloride.

As a method to make the gloss of the fiber favorable, there is the method of improving coagulation properties when spinning the polymer, that is, the method of slowing down the coagulation speed of the polymer. In order to slow down the coagulation speed, there is the method of increasing affinity to water which is the coagulant. In the present invention, a vinyl monomer containing a specific amount of a sulfonic acid group copolymerizable therewith is copolymerized in order to increase the amount of hydrophilic groups introduced into the polymer. Because the acrylic copolymer used for preparing the synthetic hair of the present invention is a copolymer containing at least three kinds of monomers of acrylonitrile, vinylidene chloride and a vinyl monomer containing a sulfonic acid group copolymerizable therewith, hydrophilic property is increased and the coagulation speed decreases and as a result, the coagulation structure tends to become even.

Examples of the vinyl monomer containing a sulfonic acid group are typical vinyl monomers containing a sulfonic acid group such as methallyl sulfonic acid, allyl sulfonic acid, isoprene sulfonic acid, styrene sulfonic acid, 2-acrylamido-2-methylpropane sulfonic acid and sulfophenyl methallyl ether or a sodium, potassium or ammonium salt thereof, but are not limited to these.

The content of the copolymerizable vinyl monomer containing a sulfonic acid group is 1 to 5% by weight, preferably 1.3 to 4% by weight, more preferably 1.5 to 3.5% by weight. When the copolymerization ratio of the monomer is less than 1% by weight, macro voids develop in the fiber formed by discharging the spinning solution when spinning, causing a decrease in gloss. When the ratio is more than 5% by weight, forming fiber tends to become difficult due to a decrease in solubility to the solvent and a tendency of increased viscosity.

The acrylic polymer used in the present invention is prepared from the monomers of the above composition ratio by emulsion polymerization, suspension polymerization or solution polymerization and at least one other vinyl monomer may be copolymerized, within the range in which the above composition ratio of the monomers is fulfilled. The content of the copolymerizable vinyl monomer is preferably at most 10% by weight.

Examples of the copolymerizable vinyl monomer are lower alkyl esters of acrylic acid or methacrylic acid; aminoalkyl esters or glycidyl esters substituted with N- or N,N-alkyl group; acrylamide, methacrylamide or a N- or N,N-alkyl substituent thereof; vinyl monomers containing a carboxyl group such as acrylic acid, methacrylic acid and itaconic acid or an anionic vinyl monomer of a sodium, potassium or ammonium salt thereof; cationic vinyl monomers such as quaternarized aminoalkyl esters of acrylic acid or methacrylic acid; lower alkyl ether containing a vinyl group; lower carboxylate ester containing vinyl group such as vinyl acetate; vinyl bromide, vinylidene cyanide, vinylidene bromide and vinyl chloride, but are not limited to these.

The acrylic polymer used in the present invention may have a mixed composition of a copolymer of the above monomer composition and another polymer which is soluble in the solvent of the copolymer. For example, another polymer, having a different composition ratio or different polymerization degree but the same monomer composition with the copolymer which is soluble in the solvent, a copolymer with at least 2 components or a homopolymer having a different monomer composition with the copolymer may be added. The component within the mixed polymer does not inhibit the effect of the present invention as long as the proportion of vinylidene chloride units is at least 25% by weight. The proportion of each monomer unit contained in the total polymer is preferably within the range which fulfills the composition ratio of the monomers.

The polymer is a copolymer containing at least three kinds of monomers. When forming fiber, the solution in which the acrylic copolymer is dissolved using a known good solvent of the acrylic copolymer such as DMAc, DMF and DMSO is used as the spinning solution. When the content of acrylonitrile is at most 55% by weight, acetone may be used as a solvent and the obtained copolymer solution is used as the spinning solution. Preferably, good solvents such as DMAc, DMF and DMSO are used.

Using a good solvent is advantageous in that not only can a polymer with high heat resistance having a high content of acrylonitrile be dissolved with ease but also a copolymer having a small proportion of acrylonitrile can be dissolved and polymers of a wide composition range can be dissolved. Furthermore, because the spinning solution discharged as fiber by coagulation when wet spinning counter diffuses with the solvent and coagulant in the coagulant bath, a fiber cross section which is relatively close to the orifice shape of the spinneret can be obtained. As a result, there is the advantage that any fiber cross section such as a circular cross section which is effective for curl setting properties or a modified cross section which provides bulkiness and softness can be reproduced and obtained with ease.

On the other hand, as mentioned above, using acetone as the solvent is problematic in that the content range of acrylonitrile is limited. Also, during coagulation when wet spinning, because the rate of one way diffusion in which the solvent within the fiber diffuses out to the coagulant bath increases, the fiber surface (periphery of the fiber cross section) becomes fixed due to coagulation. As a result, problems occur such as volume contraction occurs and a circular cross section becomes difficult to obtain and regarding modified cross sections, only a cross section with a shape slightly different from the nozzle shape can be obtained. Therefore, a method to find extremely limited specific conditions is required.

The concentration of the spinning solution depends on the polymerization degree and composition ratio of the copolymer but is preferably 20 to 35% by weight and adjusted to 30 to 800 decipascal-second, more preferably 50 to 500 decipascal·second according to the value measured at 40° C. by a rotating viscometer (B type viscometer) from the viewpoint of gloss of the fiber and handling in the preparation process. When the viscosity is less than 30 decipascal·second, the fiber properties decrease and when preparing fiber, devitrification recovery may become difficult. That is, because the diffusion to the coagulation bath of the solvent becomes fast when the viscosity is low, the coagulation becomes uneven, large voids tend to develop and improving gloss tends to become difficult even by collapsing by heating later in the drying step. On the other hand, when the viscosity is more than 800 decipascal·second, foaming becomes difficult and as viscosity increases, filtration pressure when filtering the spinning solution rises significantly and problems regarding handling arise. Also, the viscosity is preferably at least 50 decipascal·second, more preferably at least 150 decipascal·second from the viewpoint of the degree of circularity of the fiber cross section.

Compared to general fiber of a thin fineness used for clothing, in fiber of a thick fineness used for material for hair, voids develop in the fiber cross section when wet spinning and gloss is decreased. However, when an acrylic polymer with improved coagulation properties is used and wet spinning is conducted to a spinning solution which contains 3 to 25 parts by weight of water based on 100 parts by weight of the polymer, the gloss of the fiber is improved and favorable results are obtained. Also, fiber having a homogenous cross section shape with a high degree of circularity can be obtained and the content of remnant solvent within the fiber after water washing decreases. The water content in the spinning solution is more preferably 5 to 20 parts by weight based on 100 parts by weight of the acrylic polymer.

The reason for the above is believed to be because, as the change in coagulation structure becomes slow due to water, many small voids develop in the fiber cross section structure increasing homogeneity and collapsing by heating of micro voids in the drying step is sufficient. When the water content is less than 3 parts by weight, a decrease in the gloss of the fiber tends to occur. When the water content is more than 25 parts by weight, gelation of the spinning solution tends to occur and the stability of the spinning solution becomes poor, which is not preferable from the viewpoint of spinning properties. Examples of the method for including water in the spinning solution are (1) adding to the solvent solution of the acrylic copolymer, (2) using a solvent containing water as the solvent for dissolving the acrylic copolymer, (3) using the water contained in the acrylic polymer and (4) using water mixed with other additives. Two or more of these methods may be used in combination.

Additives for improving the fiber properties may be added in the spinning solution within a range which does not make carrying out the present invention difficult and the kind of additive is not particularly limited. Examples of the additives are titanium dioxide and silicon dioxide for adjusting gloss, ester or ether of cellulose derivatives such as cellulose acetate, coloring agents such as organic or inorganic pigment or dye and stabilizers for improving light resistance and heat resistance.

The spinning solution prepared by conducting defoaming is formed into fiber by air gap spinning through a spinneret or directly discharging into the coagulant bath containing a coagulant which is an aqueous solution of the solvent used in the spinning solution. In order to make the fiber cross section dense and increase the degree of circularity, the spinning solution is preferably discharged through the spinneret which has a circular orifice shape at approximately a spinneret draft ratio of 0.3 to 1.2.

The coagulant bath conditions depend on the spinning solution conditions. However, usually in the case of a good solvent, a concentration of 40 to 70% by weight and a temperature of 5° to 40° C. can be applied and in the case of acetone, a concentration of 15 to 50% by weight and a temperature of 5° to 40° C. can be applied. Also, in order to obtain a high degree of circularity using acetone as the solvent, spinning is preferably conducted under the conditions of a temperature of at most 15° C. and a acetone concentration of 50 to 75% by weight. When the solvent concentration of the coagulant bath is too low, as the coagulation is fast, the coagulation structure becomes rough forming micro voids and as a result, gloss tends to decrease. When the solvent concentration of the coagulant bath is too high, the strength of the fiber formed by discharging through the spinneret is weak and winding around the winding roller tends to become difficult. Also, when the temperature of the coagulant bath is too low, coagulation tends to be slow and when the temperature is too high, counter diffusion of the solvent and water during coagulation is advanced. As a result, the coagulation structure becomes rough and the strength of the gel fiber becomes weak and winding around the winding roller tends to become difficult.

Next, the fiber is introduced into a bath containing a thin aqueous solution having a solvent concentration lower than the coagulant bath or warm water of at least 30° C., preferably 40 to 60° C., or a hot water or boiling water bath of at least 60° C. and solvent removal, washing with water, drawing and if necessary, relaxation are conducted. The total drawing ratio is preferably 2 to 10 times, more preferably 3 to 8 times, the winding speed in the spinning coagulant bath and drawing can be divided into several stages.

Then, a process oil solution is applied to the fiber and the fiber is dried. The process oil solution is used with the purpose of preventing static and agglutination of the fiber and improving texture and may be a known oil solution. The drying temperature is preferably 110° to 190° C., more preferably 110° to 160° C., but is not particularly limited. The dried fiber is further subjected to drawing if necessary and the drawing ratio is preferably 1 to 4 times. The total drawing ratio including drawing before drying is 2.5 to 12 times the winding speed in the spinning coagulant bath. When the total drawing ratio is less than 2.5 times, the fiber properties decrease, making processing and handling difficult, and cosmetic properties such as curl properties tend to become poor. When the ratio is more than 12 times, the single yarn breakage tends to occur in the fiber preparation step and process trouble tends to occur frequently.

The fiber obtained by drying or drawing is further subjected to relaxation treatment of at least 15%. Relaxation treatment is conducted in dry heat or an overheated vapor atmosphere of a high temperature of 150 to 200° C., particularly 150 to 190° C. and/or pressurized vapor or a heated and pressurized vapor environment of 120 to 180° C. and 0.05 to 4 MPa, particularly 0.1 to 0.4 MPa. As a result, the desired fiber having improved knot strength can be obtained and in order to ensure the improvement in knot strength by relaxation treatment, relaxation of at least 15% is preferably conducted in at least a vapor environment in a pressurized and/or overheated and/or heated and pressurized state. When the temperature of the vapor atmosphere is too low, the desired relaxation ratio becomes difficult to obtain and as a result, knot strength tends to become insufficient. When the temperature is too high, coloring of the fiber advances and as a result, the fiber tends to be discolored.

The relaxation treatment can be conducted at once but is preferably conducted divided into two or more times. Particularly relaxing before drying is effective in increasing the drawing ratio after drying which greatly influences improvement in properties. However, in relaxation treatment conducted in two or more times, relaxation before drying is preferably at most half of the total relaxation. When at least half of the total relaxation is finished before drying, the collapsing effect by heating when drying decreases and as a result, improvement in gloss cannot be expected.

Here, the total relaxation ratio stands for the total of relaxation ratios and is represented as the ratio to the value of the total drawing ratio obtained by multiplying each drawing ratio, assuming the value to be 100, and is at least 15%. When the rate is at least 20%, the effect is outstanding and more preferable results can be obtained when the rate is at least 25%. When the total relaxation ratio is less than 15%, the knot strength becomes less than 0.5 cN/decitex and as a result, the hair breaks when processing as wigs and toupees. On the other hand, the upper limit is not particularly limited as long as the rate is within the range in which devitrification does not occur when dying and is roughly at most 40%, preferably at most 35%, more preferably at most 30%.

The fineness is preferably 30 to 100 decitex from the viewpoints of comparison to human hair, appearance, texture and combing properties. Preferably, the fineness is 40 to 80 decitex, more preferably 45 to 70 decitex, most preferably 45 to 60 decitex. When the fineness is less than 30 decitex, the fiber becomes too soft for texture of hair causing an increase in hackling loss and tangling by combing. Also, when the fineness is more than 100 decitex, the number of fiber composing the hair per weight unit decreases, decreasing volume and making the hair rough and hard. As a result, in both cases, the hairstyle become unnatural and the fiber is not suitable as material for hair. Here, fineness stands for the average value of the filament and the fiber bundle may contain fiber having a fineness less than 30 decitex and more than 100 decitex or have at least two fineness distribution peaks and is not particularly limited.

Regarding the surface gloss of the fiber, the gloss contrast obtained from the ratio of reflected light ranging from 0 to 90° to light exposed from an incident angle of 75° is preferably 0.88 to 0.99. Preferably the gloss contrast is at least 0.90 and more preferably at least 0.92. When the gloss contrast is less than 0.88, the fiber is unsuitable as material for hair as surface gloss is insufficient and as for when the gloss contrast is less than 0.80, the fiber seems strange as the hair becomes kempy wool-like and strays from the object of the present invention. Also, when the gloss contrast reaches 1.0, the gloss becomes artificial which is the state of specular gloss. Therefore, quality as material for hair which requires a natural gloss decreases and the fiber seems strange to be worn as synthetic hair.

Here, gloss contrast is calculated from the following equation (1).

$$G=(S-d)/S \quad (1)$$

In equation (1), G represents gloss contrast, S represents the maximum gloss degree (peak value) and d represents the gloss degree in the normal direction.

In case of conventional acrylic fiber using vinylidene chloride, in order for the gloss contrast to be at least 0.80, the fineness must be at most 25 decitex when wet spinning using a good solvent. When the fineness is higher, voids are contained during coagulation and increasing gloss contrast is difficult. The synthetic hair of the present invention has a gloss contrast of at least 0.80 even though the fineness of the filament is 30 to 100 decitex, which is thick, and was conventionally not available.

As mentioned above, the knot strength of the fiber is preferably at least 0.5 cN/decitex, more preferably at least 0.7 cN/decitex, most preferably at least 0.9 cN/decitex from the viewpoints of processability and handling of the material for hair. When the knot strength is less than 0.5 cN/decitex, many problems tend to arise, such as an increase in hackling loss and breakage of the fiber which is tangled when combing. In the process for preparing wefts, the fiber breaks when machine sewn after folding over the fiber and as a result, problems tend to increase, such as hair falls out from the weft and hair breaks when implanting the hair with an implanting needle. On the other hand, the upper limit is not particularly limited.

As the fiber cross section shape, various shapes such as a circle, 8, triangle, Y, T, +, * and other modified shapes or a hollow or skin core structure may be employed and the cross sections may be mixed. Regarding the side shape of fiber, wrinkle shape due to dents and bumps, pitch, depth thereof and wrinkle direction are not particularly limited.

However, in order to significantly improve the curl exhibiting properties of the filament, the degree of circularity of the fiber cross section is preferably at least an average of 0.8, more preferably at least 0.85, from the viewpoint of the balance between set properties, that is curl holding properties, and hairstylability. When the degree of circularity is less than 0.8 (for example, an oval to flat cross section shape), the curls set by heat are stretched a great deal by their own weight and the desired curl exhibiting properties become difficult to obtain. Improvement only in curl exhibiting properties can be achieved with an Y-shaped or + fiber cross section shape in which the degree of circularity is less than 0.8. However, in such a case, the texture is rough and hard and hairstylability decreases and as a result, the balance in qualities deteriorates and the hair properties are not suitable. Therefore, for synthetic hair balanced in setting properties and hairstylability, the degree of circularity is an important factor.

Here, when the distance between two tangent lines parallel to each other in the fiber cross section which is perpendicular to the fiber axis is the fiber width, the degree of circularity of the fiber cross section stands for the ratio of the area of the fiber cross section (F) to the area of a circle (R) of which the diameter is the maximum width of the fiber width in the fiber cross section (for example distance A between tangent lines $M_1$ and $M_2$ in FIG. 1). The value is found from the following equation (2).

$$\text{(Degree of circularity)}=\text{(Area of fiber cross section)}/\text{(Area of circle having the maximum width as the diameter)} \quad (2)$$

However, an O-shaped cross section structure in which the center of the fiber cross section is hollow or a C-shaped cross section structure which is a deformed flat cross section having a hollow center is not a satisfactory fiber cross section. When the periphery of the fiber cross section is dented and as shown in FIG. 1, dented degree h represents the ratio (%) of fiber width (B) which is the distance between tangent line ($N_1$) which is closest to dent (H) and does not cross the fiber cross section and another tangent line ($N_2$) which is parallel to tangent line ($N_1$), the dented degree (h %) is preferably at most 20%. The above dented degree (h %) is found from the following equation (3).

$$\text{Dented degree } (h\%)=100\times(b/B) \quad (3)$$

The reason for this lies in that quality as material for hair decreases as breaking, crushing and fibrillation tends to occur due to outside forces such as shampooing and combing when a large hollow area or dent is present inside the fiber as in an O-shaped cross section or C-shaped cross section.

Besides adding dye or pigment to the spinning solution, coloring to use as synthetic hair can easily be conducted by gel dyeing in the spinning step or dyeing before or after relaxation treatment and is not particularly limited. Also, an oil solution may be applied to impart texture, silkiness, combing properties and smoothness to the hair and any known oil solution may be used.

Hereinafter, the present invention is described in detail by means of Examples and Comparative Examples, but not limited thereto. Also, the chemical compositions shown in % all represent % by weight and parts all represent parts by weight. Furthermore, the total drawing ratio in the steps for preparing fiber is the value rounded off to the second decimal place and the total relaxation ratio is the value rounded off to the first decimal place. Before describing the Examples, preparation of samples and evaluation methods are as defined below.

(Viscosity of Spinning Solution)

The viscosity of the spinning solution was measured using a monocylindrical rotary viscometer Vismetron-type VSA (made by Shibaura Systems Co., Ltd.) setting the temperature of the solution to 40° C.

(Fineness)

The fineness was measured using an auto-vibronic fineness measuring instrument DENIER COMPUTER type DC-11 (made by Search Co., Ltd) and represented by the average value of 30 samples.

(Knot Strength)

The knot strength was measured according to JIS L1069-1995 6.2.1 and represented by the average value of 30 samples.

(Gloss Contrast)

The gloss contrast was measured using an automatic angle changing photometer GONIOPHOTOMETER GP-200 type (made by Murakami Color Research Laboratory). Light from a halogen lamp was used as the light source. Light was exposed through a C light source conversion filter in the fiber length direction of a fiber bundle which was combed and settled in a beam diameter of 21 mm and an incident angle of 75°. The reflected light of the exposed light was accepted in a reflection angle range of 0 to 90° in a light acceptance diameter of 13.6 mm and the reflection coefficient was measured. The light acceptance device comprises a photomultiplier (photo acceptance unit: side on type photomultiplier R 6355). As the standard for light acceptance, a standard plate with a refractive index of 1.518 (Fresnel coefficient $25.6\times10^{-2}$ at an incident angle of 75°) was used and the reflection coefficient at this time was determined to be 96.9%. The gloss contrast G was calculated from equation (1) in which d (%) represents the value in the normal direction of the specimen and S (%) represents the maximum peak value.

$$G=(S-d)/S \quad (1)$$

(Degree of Circularity)

A fiber bundle of approximately 2 mm in diameter was fixed with an epoxy type adhesive and the fiber bundle was cut in a perpendicular direction to prepare several samples for observing the fiber cross section. After the cut plane of the fiber bundle was subjected to Au deposition using an ion coater-IB-3 type (made by Eiko Engineering Co., Ltd.), the fiber cross section of the sample was photographed using a scanning electron microscope S-3500 N type (made by Hitachi, Ltd.). The maximum width (A) and area (F) was measured as shown in FIG. 1 regarding each fiber cross section. Then, the degree of circularity was found from the following equation and the average value was found for 20 fiber cross sections. The maximum width (A) and area (F) of the fiber cross section were found from image processing software Image-Hyper II (made by Interquest Co., Ltd.).

(Degree of circularity)=(Area of fiber cross section/Area of circle having the maximum width as the diameter)=$4F/(A^2\pi)$ (Preparation of Weft)

The fiber bundle was subjected to hackling and trimmed to a fiber length of 31 cm. Using a sewing machine for preparing a weft comprising triple sewing machines, 3 cm from the end of the fiber was sewn in with a double needle which is the first sewing machine at a supply rate of 28 g/100 cm. The central area of the two sewn in threads was folded in and sewing was continued from the area above the sewn in threads with the second sewing machine using a single needle. Further, approximately 3 mm from the folded area was folded over again and fixed by sewing with the single needle of the third sewing machine to prepare a weft. The length of the hair was approximately 27 to 28 cm.

(Evaluation of Curl Setting Properties)

The prepared weft was cut into a width of 12.5 cm. The weft was placed on paper wider than the cut bundle and the fiber was made flat by combing with a comb. Then, an aluminum pipe of 32 mm in diameter was on the weft in the sewing direction and both the paper and the weft were wrapped around the pipe, fixing the paper with adhesive tape to prevent loosening. After the pipe wrapped with the weft was placed in an oven adjusted to the specified temperature and heat set for 60 minutes, the weft was cooled at room temperature and the curl set weft was taken out. The sewing thread was kept parallel in the curl set weft and the drooping fiber was divided into six parts in the sewing direction and the curl shape was settled in each bundle. The distance from the sewing thread to the tip of the curl was measured over time in each bundle to measure the curling properties. For six of the samples, the distance from the sewing thread of the curled weft and to the tip of the curl was found and the curl setting properties were found from the average value thereof. The curl shape is maintained the smaller the value is.

EXAMPLE 1

A copolymer was obtained from a monomer mixture comprising 51.5% by weight of acrylonitrile, 47% by weight of vinylidene chloride and 1.5% by weight of sodium styrene sulfonate by emulsion polymerization using a redox type catalyst in a simple pressure vessel which can withstand a gauge pressure of approximately 0.1 MPa. After conducting steps such as salting out, precipitating, separating and washing with water, the copolymer was sufficiently dried and pulverized.

When vinyl chloride is included as a raw material, the raw material cannot be handled in an open system vessel and a device for high pressure gas must be used. Usually, a pressure vessel which can withstand pressure of 0.4 to 1 MPa is used and all the steps from supplying vinyl chloride monomer which is the raw material finishing the polymerization are conducted in a sealed system. On the other hand, using vinylidene chloride as the basic ingredient instead of vinyl chloride is advantageous in that handling is easy as a simple pressure vessel may be used and measurement and transferring the solution may be conducted in an open system.

The obtained copolymer was dissolved in DMF and 10 parts by weight of water were added thereto based on 100 parts by weight of the copolymer. After the solution was mixed and stirred, vacuum defoaming was conducted and the concentration was adjusted to 23% by weight to obtain the spinning solution. The viscosity of the obtained spinning solution was 290 decipascal·second.

The obtained spinning solution was discharged through a spinneret (pore diameter 0.35 mm, pore number 50) into a 10° C. coagulant bath containing a 58% by weight DMF aqueous solution. The fiber formed by spinning was introduced into a 45° C. bath containing a 30% by weight concentration DMF aqueous solution and drawn to 2.7 times and further drawn to 1.5 times in a 70° C. bath containing a 15% by weight concentration DMF aqueous solution. Then, after washing with water at 90° C. and drying at 145° C., the fiber was drawn again to 1.5 times, making the total drawing ratio 6.1 times. Then, the tension was maintained and relaxation treatment of 24% was conducted in an overheated vapor atmosphere of 190° C.

The obtained fiber had a fineness of 55 decitex, gloss contrast of 0.90, knot strength of 0.77 cN/decitex and circularity of 0.72.

A weft was prepared with this fiber. In the same manner as commercially available synthetic hair Kanekalon Tiara™ (available from Kaneka Corporation) which is acrylic fiber obtained by copolymerizing acrylonitrile and vinyl chloride used for comparison, hair breaking by the sewing machine step for preparing the weft or by combing did not occur and so the fiber bundle was favorable. After curl setting, the curls were settled and the gloss was observed. The gloss was natural and the fiber closely resembled human hair.

COMPARATIVE EXAMPLE 1

The copolymer obtained in Example 1 was dissolved in DMF which does not contain water and the concentration was adjusted to 23% to obtain the spinning solution. The viscosity of the spinning solution was 280 decipascal·second. The fiber was prepared in the same manner as in Example 1. The obtained fiber had a fineness of 55 decitex, gloss contrast of 0.84, knot strength of 0.75 cN/decitex and circularity of 0.78.

A weft was prepared with this fiber and hair breaking was observed by combing. As a result, in the same manner as Example 1, hair breaking by the sewing machine step for preparing the weft or by combing did not occur. However, after curl setting, when the curls were settled and the gloss was observed, the gloss was dull and the appearance was whitish. As a result, though the fiber had fineness similar to that of the fiber of Example 1, the thickness was emphasized and extremely noticeable and so the fiber was unsuitable as synthetic hair.

EXAMPLE 2

A copolymer comprising 57% of acrylonitrile, 40.8% of vinylidene chloride and 2.2% of 2-acrylamido-methylpropane sulfonic acid sodium salt was dissolved in DMF. 12 parts of water was added thereto based on 100 parts of the copolymer and the concentration was adjusted to 29% to obtain the spinning solution. The viscosity of the obtained spinning solution was 98 decipascal·second.

The obtained spinning solution was discharged through a spinneret (pore diameter 0.30 mm, pore number 112) into a 20° C. coagulant bath containing a 58% concentration DMF aqueous solution. The fiber was introduced into a 45° C. bath containing a 30% concentration DMF aqueous solution and drawn to 4 times and further drawn to 1.1 times in a 70° C. bath containing a 15% concentration of DMF aqueous solution, making the total drawing ratio 4.4 times. Then, the fiber was washed and subjected to relaxation treatment of 9% with hot water of 90° C. Further, an oil solution was applied and drying was conducted at 145° C. Then, the tension was maintained and relaxation treatment of 22% was conducted in a pressurized vapor atmosphere of 0.26 MPa, making the total relaxation ratio 29%.

The obtained fiber had a fineness of 52 decitex, gloss contrast of 0.94, knot strength of 1.06 cN/decitex and circularity of 0.73.

A weft was prepared with this fiber. In the same manner as in Example 1, the fiber was equal to the synthetic hair fiber used for comparison and hair breaking by the sewing machine step did not occur. The obtained weft was combed but the hair did not break or fall out and so the weft was favorable.

COMPARATIVE EXAMPLE 2

A copolymer comprising 51.5% of acrylonitrile, 48% of vinylidene chloride and 0.5% of sodium styrene sulfonate was dissolved in DMF. 12 parts of water was added thereto based on 100 parts of the copolymer and the concentration was adjusted to 29.5% to obtain the spinning solution. The viscosity of the obtained spinning solution was 200 decipascal·second. Spinning was conducted in the same manner as in Example 2 by passing the spinning solution through a spinneret (pore diameter 0.22 mm, pore number 50) and the fiber was obtained.

The obtained fiber had a fineness of 50 decitex, gloss contrast of 0.79 and knot strength of 0.97 cN/decitex. A weft was prepared using this fiber in the same manner as in Example 1 and though hair breaking by the sewing machine step did not occur and the hair did not break or fall out when the weft was combed, regarding the appearance, the gloss was not vivid and the quality was unsuitable as material for synthetic hair.

EXAMPLE 3

The filament obtained in Example 2 which was subjected to relaxation treatment in a pressurized vapor atmosphere was maintained in a tension state and subjected to further relaxation of 1.6% in a hot air atmosphere of 190° C., making the total relaxation ratio of relaxation treatment conducted in three times 30%. The obtained fiber had a fineness of 53 decitex, gloss contrast of 0.92 and knot strength of 1.18 cN/decitex.

EXAMPLE 4

A copolymer comprising 56% of acrylonitrile, 42.2% of vinylidene chloride and 1.8% of sodium methallyl sulfonate was dissolved in DMF. 17 parts of water was added thereto based on 100 parts of the copolymer and the concentration was adjusted to 26% to obtain the spinning solution. The viscosity of the obtained spinning solution was 130 decipascal·second.

The spinning solution was discharged through a spinneret (pore diameter 0.30 mm, pore number 112) into a 20° C. coagulant bath containing a 58% concentration DMF aqueous solution. The fiber was introduced into a 75° C. bath containing a 30% concentration DMF aqueous solution and drawn to 4 times and further drawn to 1.1 times in a 80° C. bath containing a 15% concentration DMF aqueous solution, making the total drawing ratio 4.4 times. Then, the fiber was washed and subjected to relaxation treatment of 9% with hot water of 90° C. Further, an oil solution was applied and drying was conducted at 145° C. Then, the tension was maintained and relaxation treatment of 25% was conducted in a pressurized vapor atmosphere of 0.26 MPa, making the total relaxation ratio 32%.

The obtained fiber had a fineness of 48 decitex, gloss contrast of 0.93, knot strength of 1.16 cN/decitex and circularity of 0.94.

A weft was prepared with this fiber. As in Example 1, hair breaking by the sewing machine step was as little as that of commercially available synthetic hair Kanekalon Tiara™ (available from Kaneka Corporation) used for comparison. The obtained weft was combed but the hair did not break or fall out and so the fiber bundle was favorable.

EXAMPLE 5

The copolymer used in Example 4 was dissolved in DMAc. 11 parts of water was added thereto based on 100 parts of the copolymer and the solution was mixed. The concentration was adjusted to 26% to prepare the spinning solution. The viscosity of the spinning solution was 210 decipascal·second.

The spinning solution was discharged through a spinneret (pore diameter 0.30 mm, pore number 112) into a 30° C. coagulant bath containing a 50% concentration DMAc aqueous solution. The fiber was introduced into a 80° C. hot water bath and drawn to 4 times and further drawn to 1.1 times in a 85° C. hot water bath, making the total drawing ratio 4.4 times. Then, the fiber was washed and subjected to relaxation treatment of 9% with hot water of 90° C. Further, an oil solution was applied and drying was conducted at 145° C. Then, the tension was maintained and relaxation treatment of 30% was conducted in a pressurized vapor atmosphere of 0.27 MPa, making the total relaxation ratio 36%.

Figure 2:
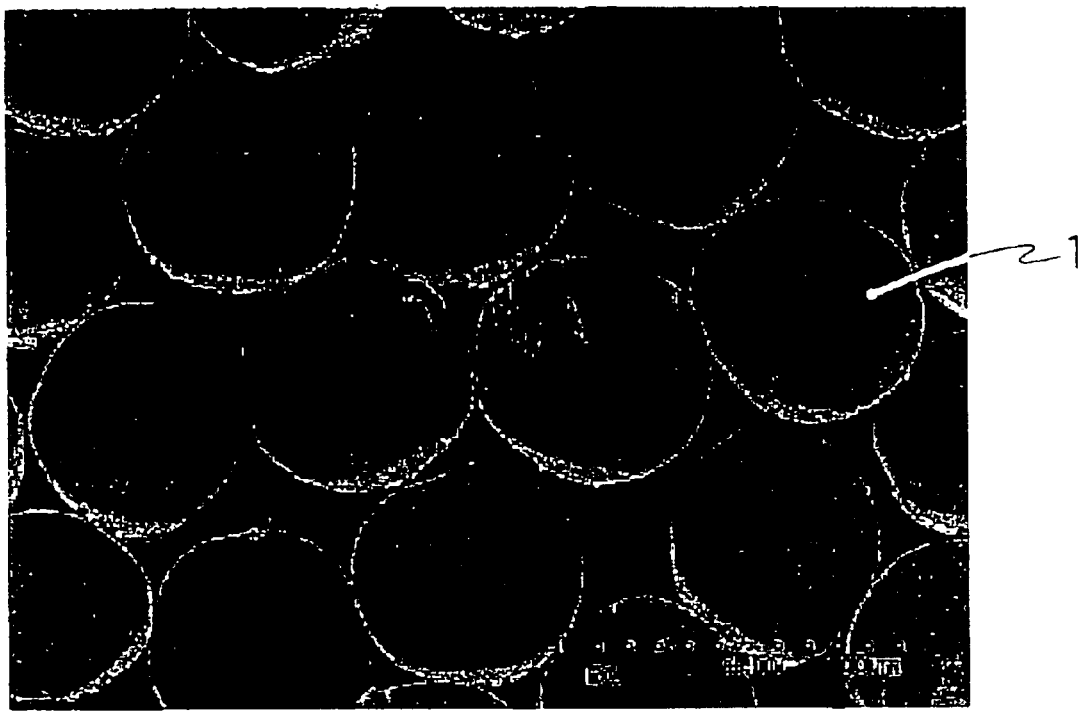
FIG. 2 is a photograph of the cut plane of the fiber bundle prepared in Example 5 taken by a scanning electron microscope.

The obtained fiber had a fineness of 55 decitex, gloss contrast of 0.94 and knot strength of 1.10 cN/decitex. Also, as shown in FIG. 2, fiber cross section 1 was almost circular and the degree of circularity was 0.93.

A weft was prepared with this fiber. As in Example 1, hair breaking by the sewing machine step was as little as that of commercially available synthetic hair Kanekalon Tiara™

(available from Kaneka Corporation) used for comparison. The obtained weft was combed but the hair did not break or fall out and so the fiber bundle was favorable. Also, as shown in Table 3, the curls set under heat setting conditions of 110° C. were 13.1 cm immediately after setting and 17.1 cm one week later. Under heat setting conditions of 150° C., the curls were 12.6 cm immediately after setting and 16.6 cm one week later. Under both conditions, the curl shape was tighter and more favorable than that obtained in Comparative Example 6 described below.

EXAMPLE 6

The filament obtained in Example 5 which was subjected to relaxation treatment in a pressurized vapor atmosphere was maintained in a tension state and subjected to further relaxation of 1.3% in a hot air atmosphere of 190° C., making the total relaxation ratio 37%. The obtained fiber had a fineness of 56 decitex, gloss contrast of 0.94 and knot strength of 1.36 cN/decitex.

EXAMPLE 7

A copolymer comprising 57% of acrylonitrile, 40.5% of vinylidene chloride and 2.5% of 2-acrylamido-methylpropane sulfonic acid sodium salt was dissolved in DMF. 12 parts of water was added thereto based on 100 parts of the copolymer and stirring and vacuum defoaming were conducted. Then, the concentration was adjusted to 29% to obtain the spinning solution. The viscosity of the obtained spinning solution was 120 decipascal·second.

The obtained spinning solution was discharged through a spinneret (pore diameter 0.35 mm, pore number 50) into a 20° C. coagulant bath containing a 60% concentration DMF aqueous solution. The fiber was introduced into a 45° C. bath containing a 30% concentration DMF aqueous solution and drawn to 3 times and further drawn to 1.7 times in a 70° C. bath containing a 15% concentration DMF aqueous solution, making the total drawing ratio 5.1 times. Then, the fiber was washed and subjected to relaxation treatment of 4% with hot water of 90° C. Further, an oil solution was applied and drying was conducted at 145° C. Then, the tension was maintained and relaxation treatment of 18% was conducted in a pressurized vapor atmosphere of 0.23 MPa, making the total relaxation ratio 21%.

The obtained fiber had a fineness of 67 decitex, gloss contrast of 0.96, knot strength of 0.76 cN/decitex and circularity of 0.74.

A weft was prepared with this fiber and hair breaking by the sewing machine step did not occur as in commercially available synthetic hair Kanekalon Tiara™ (available from Kaneka Corporation) used for comparison. The obtained weft was combed but the hair did not break or fall out.

EXAMPLE 8

A copolymer comprising 58% of acrylonitrile, 40% of vinylidene chloride and 2% of sodium methallyl sulfonate was dissolved in DMAc. 11 parts of water was added thereto based on 100 parts of the copolymer and the concentration was adjusted to 28% to obtain the spinning solution. The viscosity of the obtained spinning solution was 360 decipascal·second.

The spinning solution was discharged through a spinneret (pore diameter 0.30 mm, pore number 50) into a 20° C. coagulant bath containing a 58% concentration DMAc aqueous solution. The fiber was introduced into a 75° C. bath containing a 30% concentration DMF aqueous solution and drawn to 4 times and further drawn to 1.1 times in a 80° C. bath containing a 15% concentration DMF aqueous solution, making the total drawing ratio 4.4 times. Then, the fiber was washed and subjected to relaxation treatment of 4% in a hot water bath of 90° C. Further, a spinning oil solution was applied in an oil solution bath and the fiber was introduced into a hot air dryer of 130° C. and then 160° C. and dried. Then, the tension was maintained and the fiber was subjected to relaxation treatment of 10% in a pressurized vapor atmosphere of 0.1 MPa, making the total relaxation ratio 14%.

The obtained fiber had a fineness of 55 decitex, gloss contrast of 0.93 and knot strength of 0.43 cN/decitex.

A weft was prepared using this fiber but hair breaking in the sewing machine step occurred frequently. Even when the obtained weft was cut into a width of 30 cm, bundled and combed, the hair broke and fell out significantly. However, with respect to the appearance, the curl set weft had a natural gloss and closely resembled human hair.

EXAMPLE 9

A copolymer comprising 57% of acrylonitrile, 41% of vinylidene chloride and 2% of 2-acrylamido-methylpropane sulfonic acid sodium salt was dissolved in DMF. 12 parts of water was added thereto based on 100 parts of the copolymer and the concentration was adjusted to 29% to obtain the spinning solution. The viscosity of the obtained spinning solution was 100 decipascal·second.

The obtained spinning solution was discharged through a spinneret having Y-shaped slits (area of 1 slit 0.096 $mm^2$, pore number 50) into a 20° C. coagulant bath containing a 58% concentration DMF aqueous solution. The fiber was introduced into a 45° C. bath containing a 30% concentration DMF aqueous solution and drawn to 2 times and further drawn to 1.5 times in a 70° C. bath containing a 15% concentration DMF aqueous solution. Then, the fiber was washed and subjected to relaxation treatment of 4% with hot water of 90° C. Further, an oil solution was applied and drying was conducted at 145° C. Drawing to 2 times was conducted and the total drawing ratio obtained by multiplying each drawing ratio became 6 times. Then, the tension was maintained and relaxation treatment of 25% was conducted in a pressurized vapor atmosphere of 0.26 MPa, making the total relaxation ratio of the two relaxation treatments 28%.

The cross section shape of the obtained fiber was Y-shaped, similar to the spinneret shape. Regarding the physical properties, the fiber had a fineness of 48 decitex, gloss contrast of 0.95 and knot strength of 1.0 cN/decitex.

A weft was prepared with this fiber. As in Example 1, hair breaking by the sewing machine step did not occur as in commercially available synthetic hair Kanekalon Tiara™ (available from Kaneka Corporation) used for comparison. The obtained weft was cut into a width of 30 cm, bundled and combed but the hair did not break or fall out and so the fiber was favorable.

COMPARATIVE EXAMPLE 3

A copolymer comprising 51.5% of acrylonitrile, 48% of vinylidene chloride and 0.5% of sodium styrene sulfonate was dissolved in DMF. 10 parts of water was added thereto based on 100 parts of the copolymer and the mixture was stirred. Then, vacuum defoaming was conducted and the concentration was adjusted to 29.5% to obtain the spinning solution. The viscosity of the obtained spinning solution was 180 decipascal·second.

The spinning solution was discharged through a spinneret (pore diameter 0.30 mm, pore number 50) into a 20° C. coagulant bath containing a 60% concentration DMF aqueous solution. The fiber was introduced into a 45° C. bath containing a 30% concentration DMF aqueous solution and drawn to 3 times and further drawn to 1.7 times in a 70° C. bath containing a 15% concentration DMF aqueous solution, making the total drawing ratio 5.1 times. Then, after imparting a process oil solution, the fiber was dried in a hot air dryer of 130° C. and then 160° C. The tension was maintained and relaxation treatment of 10% was conducted in a pressurized vapor atmosphere of 0.1 MPa.

The obtained fiber had a fineness of 56 decitex, gloss contrast of 0.81 and knot strength of 0.32 cN/decitex. A weft was prepared with this fiber in the same manner as in Example 1. Hair breaking occurred in the sewing machine step and when the weft was combed, the hair broke and fell out. Furthermore, regarding the appearance, the gloss was not vivid and the quality was unsuitable as material for synthetic hair.

COMPARATIVE EXAMPLE 4

A copolymer comprising 57.5% of acrylonitrile, 40.5% of vinylidene chloride and 2% of 2-acrylamido-methylpropane sulfonic acid sodium salt was dissolved in DMF. Vacuum defoaming was conducted and the concentration was adjusted to 29% to obtain the spinning solution. The viscosity of the obtained spinning solution was 92 decipascal·second.

The spinning solution was discharged through a spinneret (pore diameter 0.25 mm, pore number 50) into a 20° C. coagulant bath containing a 58% concentration DMF aqueous solution. The fiber was introduced into a 45° C. bath containing a 30% concentration DMF aqueous solution and drawn to 4 times and further drawn to 1.1 times in a 70° C. bath containing a 15% concentration DMF aqueous solution, making the total drawing ratio 4.4 times. Then, the fiber was washed with hot water of 90° C. and after imparting a process oil solution, the fiber was dried in a hot air dryer of 130° C. and then 160° C. The tension was maintained and relaxation treatment of 10% was conducted in a pressurized vapor atmosphere of 0.1 MPa.

Figure 4:
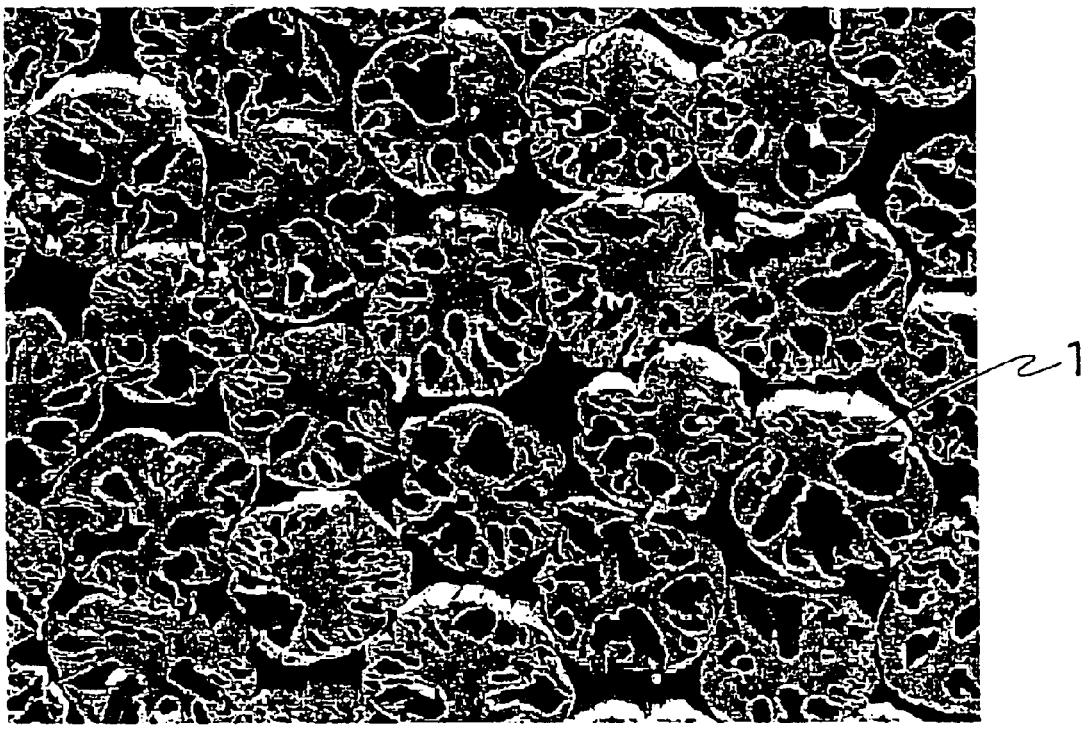
FIG. 4 is a photograph of the cut plane of the fiber bundle prepared in Comparative Example 4 taken by a scanning electron microscope.

The obtained fiber had a fineness of 54 decitex, gloss contrast of 0.83 and knot strength of 0.36 cN/decitex. As shown in FIG. 4, fiber cross section 1 was circular but many micro voids, which are detrimental to fiber properties such as gloss and knot strength, were found. The degree of circularity was 0.91.

A weft was prepared with this fiber in the same manner as in Example 1. Hair breaking occurred in the sewing machine step and when the weft was cut into a width of 30 cm, bundled and combed, the hair broke and fell out. Furthermore, regarding the appearance, the gloss was not vivid and the quality was unsuitable as material for synthetic hair.

COMPARATIVE EXAMPLE 5

A copolymer comprising 56% of acrylonitrile, 42.2% of vinylidene chloride and 1.8% of sodium methallyl sulfonate was dissolved in DMAc. The concentration was adjusted to 26% to obtain the spinning solution. The viscosity of the obtained spinning solution was 190 decipascal·second.

The spinning solution was discharged through a spinneret (pore diameter 0.30 mm, pore number 112) into a 20° C. coagulant bath containing a 50% concentration DMAc aqueous solution. The fiber was introduced into a 80° C. hot water bath and drawn to 3.2 times and further drawn to 1.5 times in a 90° C. hot water bath. Then, a process oil solution was applied and the fiber was dried at 145° C. Drawing to 1.5 times was conducted in a saturated vapor atmosphere of 95° C., making the total drawing ratio obtained by multiplying each drawing ratio 7.2 times. Then, the tension was maintained and relaxation treatment of 25% was conducted by injecting pressurized vapor in an atmosphere with a dry heat temperature set to 110° C. and drying was conducted.

The obtained fiber had a fineness of 52 decitex, gloss contrast of 0.86, knot strength of 0.82 cN/decitex and circularity of 0.84.

A weft was prepared using this fiber and as in Example 1, hair breaking in the sewing machine step did not occur. The obtained weft was combed but the hair did not break or fall out. However, the gloss was insufficient and the material was unsuitable for synthetic hair.

COMPARATIVE EXAMPLE 6

A copolymer comprising 51.5% of acrylonitrile, 48% of vinylidene chloride and 0.5% of sodium styrene sulfonate was dissolved in acetone. The concentration was adjusted to 29.5% to obtain the spinning solution. The viscosity of the obtained spinning solution was 62 decipascal·second.

The spinning solution was discharged through a spinneret (pore diameter 0.30 mm, pore number 50) into a 20° C. coagulant bath containing a 18% concentration acetone aqueous solution. The fiber was introduced into a 55° C. bath containing a 5% acetone aqueous solution and drawn to 1.5 times and then introduced in a 65° C. warm water bath for washing. Then, a process oil solution was applied and drying was conducted at 120° C. Drawing to 2.5 times was conducted at the same temperature, making the total drawing ratio 3.8 times. Then, relaxation treatment of 5% was conducted at 150° C. and another 5% in an overheated vapor atmosphere of 190° C., making the total relaxation ratio of the relaxation treatment 10%.

Figure 3:
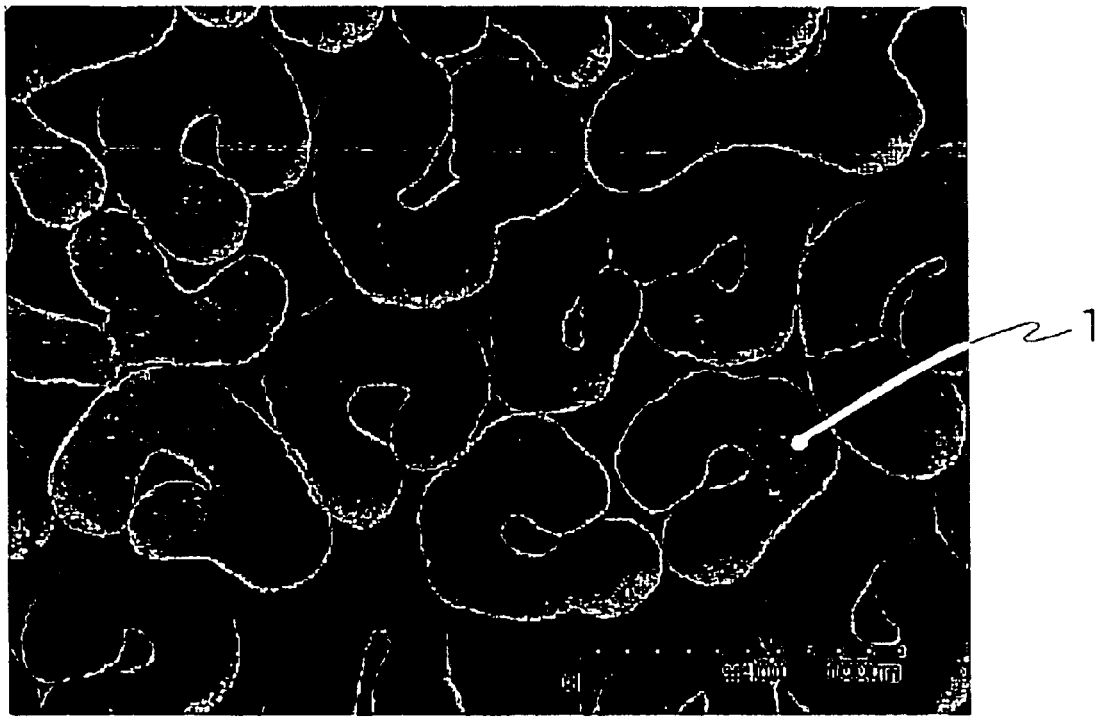
FIG. 3 is a photograph of the cut plane of the fiber bundle prepared in Comparative Example 6 taken by a scanning electron microscope.

The obtained fiber had a fineness of 56 decitex, gloss contrast of 0.97 and knot strength of 0.45 cN/decitex. As shown in FIG. 3, most of the fiber cross section 1 were an irregular cross section close to a C-shape and the degree of circularity was 0.71.

A weft was prepared with this fiber in the same manner as in Example 1 and hair breaking occurred by the sewing machine step. The obtained weft was combed and the hair broke and fell out. Also, as shown in Table 3, the curls set under heat setting conditions of 110° C. were 17.7 cm immediately after setting and 20.3 cm one week later. In curl setting at 150° C., a great deal of frizzing occurred and so curl setting was conducted at 130° C. As a result, the curls were 17.3 cm immediately after setting and 19.8 cm one week later.

TABLE 1

| | Ex. 1 | Ex. 2 | Ex. 3 | Ex. 4 |
|---|---|---|---|---|
| Vinyl Momomer Containing a Sulfonic Acid Group | Sodium Styrene Sulfonate | 2-acrylamido-2-methylpropane Sulfonic Acid Sodium Salt | 2-acrylamido-2-methylpropane Sulfonic Acid Sodium Salt | Sodium Methallyl Sulfonate |
| Copolymerization Amount (%) | 1.5 | 2.2 | 2.2 | 1.8 |
| Solvent | DMF | DMF | DMF | DMF |
| Amount of Water (parts) | 10 | 12 | 12 | 17 |
| Drawing Ratio in Bath (times) | 4.05 | 4.4 | 4.4 | 4.4 |
| Drawing Ratio after Drying (times) | 1.5 | 1 | 1 | 1 |
| Total Drawing Ratio (times) | 6.1 | 4.4 | 4.4 | 4.4 |
| Relaxation ratio in hot water or saturated vapor (%) | 0 | 9 | 9 | 9 |
| Relaxation ratio in overheated or pressurized vapor (%) | 24 | 22 | 22 | 25 |
| Relaxation ratio in hot air (%) | 0 | 0 | 1.6 | 0 |
| Total relaxation ratio (%) | 24 | 29 | 30 | 32 |
| Fineness (decitex) | 55 | 52 | 53 | 48 |
| Gloss Contrast | 0.90 | 0.94 | 0.92 | 0.93 |
| Knot Strength (cN/decitex) | 0.77 | 1.06 | 1.18 | 1.16 |

| | Ex. 5 | Ex. 6 | Ex. 7 | Ex. 8 | Ex. 9 |
|---|---|---|---|---|---|
| Vinyl Momomer Containing a Sulfonic Acid Group | Sodium Methallyl Sulfonate | Sodium Methallyl Sulfonate | 2-acrylamido-2-methylpropane Sulfonic Acid Sodium Salt | Sodium Methallyl Sulfonate | 2-acrylamido-2-methylpropane Sulfonic Acid Sodium Salt |
| Copolymerization Amount (%) | 1.8 | 1.8 | 2.5 | 2 | 2 |
| Solvent | DMAc | DMAc | DMF | DMAc | DMF |
| Amount of Water (parts) | 11 | 11 | 12 | 11 | 12 |
| Drawing Ratio in Bath (times) | 4.4 | 4.4 | 5.1 | 4.4 | 3 |
| Drawing Ratio after Drying (times) | 1 | 1 | 1 | 1 | 2 |
| Total Drawing Ratio (times) | 4.4 | 4.4 | 5.1 | 4.4 | 6 |
| Relaxation ratio in hot water or saturated vapor (%) | 9 | 9 | 4 | 4 | 4 |
| Relaxation ratio in overheated or pressurized vapor (%) | 30 | 30 | 18 | 10 | 25 |
| Relaxation ratio in hot air (%) | 0 | 1.3 | 0 | 0 | 0 |
| Total relaxation ratio (%) | 36 | 37 | 21 | 14 | 28 |
| Fineness (decitex) | 55 | 56 | 67 | 55 | 55 |
| Gloss Contrast | 0.94 | 0.94 | 0.96 | 0.93 | 0.95 |
| Knot Strength (cN/decitex) | 1.10 | 1.36 | 0.76 | 0.43 | 1.0 |

TABLE 2

| | Com. Ex. 1 | Com. Ex. 2 | Com. Ex. 3 | Com. Ex. 4 | Com. Ex. 5 | Com. Ex. 6 |
|---|---|---|---|---|---|---|
| Vinyl Momomer Containing a Sulfonic Acid Group | Sodium Styrene Sulfonate | Sodium Styrene Sulfonate | Sodium Styrene Sulfonate | 2-acrylamido-2-methylpropane Sulfonic Acid Sodium Salt | Sodium Methallyl Sulfonate | Sodium Styrene Sulfonate |
| Copolymerization Amount (%) | 1.5 | 0.5 | 0.5 | 2.2 | 1.8 | 0.5 |
| Solvent | DMF | DMF | DMF | DMF | DMAc | Acetone |
| Amount of Water (parts) | 0 | 12 | 10 | 0 | 0 | 0 |
| Drawing Ratio in Bath (times) | 4.05 | 4.4 | 5.1 | 4.4 | 4.8 | 1.5 |
| Drawing Ratio after Drying (times) | 1.5 | 1 | 1 | 1 | 1.5 | 2.5 |
| Total Drawing Ratio (times) | 6.1 | 4.4 | 5.1 | 4.4 | 7.2 | 3.8 |
| Relaxation ratio in hot water or saturated vapor (%) | 0 | 9 | 0 | 0 | 25 | 0 |
| Relaxation ratio in overheated or pressurized vapor (%) | 24 | 22 | 10 | 10 | 0 | 5 |
| Relaxation ratio in hot air (%) | 0 | 0 | 0 | 0 | 0 | 5 |
| Total relaxation ratio (%) | 24 | 29 | 10 | 10 | 25 | 10 |
| Fineness (decitex) | 55 | 50 | 56 | 54 | 52 | 56 |
| Gloss Contrast | 0.84 | 0.79 | 0.81 | 0.83 | 0.86 | 0.97 |
| Knot Strength (cN/decitex) | 0.75 | 0.97 | 0.32 | 0.36 | 0.82 | 0.45 |

TABLE 3

| | Ex. 5 | | Com. Ex. 6 | |
|---|---|---|---|---|
| Curl Setting Temperature (° C.) | 110 | 150 | 110 | 130 |
| Length of Hair Bundle in a Curled State (cm) | | | | |
| Immediately after Curl Setting | 13.1 | 12.6 | 17.7 | 17.3 |
| 1 Hour later | 14.6 | 14.4 | 18.5 | 18.1 |
| 1 Day later | 16.1 | 15.8 | 19.4 | 19.1 |
| 1 Week later | 17.1 | 16.6 | 20.3 | 19.8 |

INDUSTRIAL APPLICABILITY

The synthetic hair obtained by the present invention comprises fiber composed of a specific acrylic copolymer obtained from acrylonitrile and vinylidene chloride. Because processability is improved, the fiber has commercial properties equal to those of conventional fiber containing an acrylic copolymer comprising acrylonitrile and vinyl chloride. Therefore, the fiber is suitable as material for hair used in wigs, toupees, hair pieces, weavings, extensions and braids.

What is claimed is:

1. Synthetic hair comprising fiber obtained from an acrylic polymer comprising 40 to 74% by weight of acrylonitrile, 25 to 59% by weight of vinylidene chloride and 1 to 5% by weight of a vinyl monomer containing a sulfonic acid group copolymerizable therewith, wherein said fiber has a gloss contrast of at least 0.88 and an average filament fineness of 30 to 100 decitex.

2. The synthetic hair of claim 1, wherein said fiber has a knot strength of at least 0.5 cN/decitex.

3. The synthetic hair of claim 1, wherein said fiber is obtained by wet spinning using a good solvent.

4. The synthetic hair of claim 2, wherein said fiber is obtained by wet spinning using a good solvent.

5. The synthetic hair of claim 3, wherein said good solvent is at least one member selected from the group consisting of dimethylformamide, dimethylacetamide and dimethyl sulfoxide.

6. The synthetic hair of claim 4, wherein said good solvent is at least one member selected from the group consisting of dimethylformamide, dimethylacetamide and dimethyl sulfoxide.

7. A process for preparing synthetic hair which comprises the steps of:

preparing a spinning solution containing, in a polymer solution of an acrylic polymer comprising 40 to 74% by weight of acrylonitrile, 25 to 59% by weight of vinylidene chloride and 1 to 5% by weight of a vinyl monomer containing a sulfonic acid group copolymerizable therewith and a good solvent, 3 to 25 parts by weight of water based on 100 parts by weight of said polymer, forming fiber by wet spinning said spinning solution, conducting drawing treatment so that the total drawing ratio of said fiber becomes 2.5 to 12 times and conducting relaxing treatment so that the total relaxation ratio of said fiber becomes at least 15%.

8. The process of claim 7, wherein said relaxing treatment is divided into two or more times.

9. The process of claim 7, wherein said relaxing treatment is conducted in a vapor atmosphere of a pressurized and/or overheated state after drying said fiber.

10. The process of claim 8, wherein said relaxing treatment is conducted in a vapor atmosphere of a pressurized and/or overheated state after drying said fiber.

11. The process of claim 9, wherein said vapor atmosphere has a temperature of 120° to 200° C.

12. The process of claim 10, wherein said vapor atmosphere has a temperature of 120° to 200° C.

* * * * *